US005170209A

United States Patent [19]

Tompkins et al.

[11] Patent Number: 5,170,209

[45] Date of Patent: Dec. 8, 1992

[54] PROCESS CARTRIDGE FOR AN INTERMEDIATE TRANSFER ELECTROPHOTOGRAPHIC PRINT ENGINE

[75] Inventors: E. Neal Tompkins, Atlanta; Danny Slayton, Lilburn; Keith J. Bradley, Norcross, all of Ga.

[73] Assignee: Colorocs Corporation, Norcross, Ga.

[21] Appl. No.: 658,647

[22] Filed: Feb. 20, 1991

[51] Int. Cl.[5] ..... G03G 15/00

[52] U.S. Cl. ..... 355/200; 355/212; 355/271

[58] Field of Search ..... 355/200, 211, 212, 245, 355/326-327, 271, 260

[56] References Cited

U.S. PATENT DOCUMENTS

| | | | |
|---|---|---|---|
| 4,652,115 | 3/1987 | Palm et al. | 355/327 |
| 4,678,318 | 7/1987 | Bisaiji . | |
| 4,771,313 | 9/1988 | Kuroda et al. . | |
| 4,786,937 | 11/1988 | Bouwens . | |
| 4,809,033 | 2/1989 | Ikemoto et al. . | |
| 4,829,335 | 5/1989 | Kanemitsu et al. . | |
| 4,873,548 | 10/1989 | Kobayashi et al. . | |
| 4,876,572 | 10/1989 | Nagatsuna | 355/200 X |
| 4,888,620 | 12/1989 | Fujino et al. . | |
| 4,996,566 | 2/1991 | Morita et al. | 355/326 X |
| 5,023,670 | 6/1991 | Kita et al. | 355/326 |
| 5,049,940 | 9/1991 | Yamaguchi et al. | 355/260 |

*Primary Examiner*—Joan H. Pendegrass

*Attorney, Agent, or Firm*—Ross, Howison, Clapp & Korn

[57] ABSTRACT

A process cartridge (14) is comprised of a process housing (138) and a transfer housing (148). The process housing (138) contains a photoconductor drum (16) and an intermediate transfer belt (160). The transfer belt (160) is operable to receive multiple images from the photoconductor drum (16) until a composite image is formed on the transfer belt (160). Thereafter, the transfer housing (140) is titled into contact with a backup roller (162) in the process housing (138) through a transfer roller (208). The nip between the two rollers is then operable to feed a piece of paper therethrough and transfer the composite image from the transfer belt (160) to the paper. Alignment pins (114) and (116) on the upper end of the housing and lower alignment pins (118) and (120) on the lower end of the process housing (138) are provided to fit in the guide rails (110) and (112), which provide an alignment function. A driving gear (128) on the end of a motor shaft (132) is operable to drive the photoconductor drum (16) through a gear (126) and subsequently drive all of the processing elements therein.

13 Claims, 6 Drawing Sheets

PROCESS CARTRIDGE FOR AN INTERMEDIATE TRANSFER ELECTROPHOTOGRAPHIC PRINT ENGINE

TECHNICAL FIELD OF THE INVENTION

The present invention pertains in general to electrophotographic print engines and, more particularly, to the inclusion of a number of the key processing elements of the print engine in a removable cartridge.

BACKGROUND OF THE INVENTION

In order to enhance the serviceability of an electrophotographic print engine, some systems in the past have incorporated a "cartridge" concept wherein certain portions of the engine are enclosed in a removable cartridge. This allows all elements in the cartridge to be replaced at a single time.

One conventional example of the cartridge concept is that utilized with respect to toner cartridges. In toner cartridges, the toner, the toner delivering apparatus, the photoconductor drum and the cleaning blade or various elements are contained in a single module. This allows a user to both replenish the toner and to also replace all the components that would be subjected to wear over the duration of a given toner capacity of a cartridge. Typically, the elements that wear in the cartridge are of a lower quality than those used in non-cartridge based machines. Therefore, the cartridges can be manufactured with less expensive components, as compared to machines that only allow replacement of the toner. When the elements such as the photoconductor drum, the cleaning blades, etc. wear out in non-cartridge machines, it is necessary to place a service call, which can be relatively expensive compared to the price of the actual machine itself.

When servicing a print engine, it is usually necessary to perform a number of alignment tasks to ensure that the copier is obtaining adequate registration. This is especially the case with a copier utilized to generate multi-layer copies, such as in a color print engine. It is important in color print engines that the multiple copies have a very tight tolerance on registration to ensure that any overlapping of images for the various developing steps are minimized. However, when parts such as the photoconductor drum, etc. are replaced, this alignment can be an important and time consuming procedure for the service technician.

In one type of color copier system, that disclosed in U.S. Pat. No. 4,652,115, issued to the present Assignee, an intermediate transfer system is disclosed which requires very tight registration tolerances with respect to a photoconductor drum and an intermediate transfer member. Whenever any portion of the main photoconductor drum or the intermediate transfer member are replaced or adjusted, a service technician must assure that the alignment is correct. This renders the system a virtually nonuser-friendly system, wherein a user cannot perform any of the service himself and must rely upon a service technician.

In view of the above disadvantages, there exists a need for a system for decreasing the maintenance requirements for color copiers, especially for ones that require tight registration tolerance.

SUMMARY OF THE INVENTION

The present invention disclosed and claimed herein comprises a process cartridge for a multi-layer electrophotographic print engine. The process cartridge includes a housing and an alignment device associated with the housing for aligning and securing the housing in the electrophotographic engine in an operating position. A plurality of process elements are contained within the housing that are utilized to process a latent image to a final developed composite image, the composite image operable to have two or more layers. A driving apparatus is contained within the housing that interfaces with an external driving mechanism. The driving apparatus drives the plurality of processing elements within the housing to control the operation of the processing elements to develop and form the multi-layer composite image.

In another aspect of the present invention, the alignment device includes a plurality of alignment pins disposed on the sides of the housing. The alignment pins are operable to interface with slots in an alignment frame on either side of the housing such that the housing can vertically drop into the electrophotographic engine between the alignment frames. A hold down device is provided for forcing the housing into a secure position within the slots.

In a further aspect of the present invention, the processing elements are arranged such that they are interfaced with an external illumination device for allowing a latent image to be exposed within the housing and also be interfaced with external toner devices for receiving toner for developing of the latent image within the housing. The processing elements include at least one photoconductor element for carrying the latent image and the developed image after interfacing with the external toner elements. The external toner elements are operable to include two or more different toners for forming the different layers of the multi-layer composite image.

In a yet further aspect of the present invention, the photoconductor element includes a photoconductor drum that is operable to have a portion thereof exposed to the exterior of the cartridge for interfacing with the external toner modules and also for receiving an exposure stimulus for forming a latent image thereon. An intermediate transfer device is included in the housing for interfacing with the photoconductor element to receive the developed image therefrom. The process continues until multiple developed images have been transferred from the photoconductor element to the intermediate transfer device to form the multi-layer composite image. A transfer mechanism is then operable to transfer the composite image from the transfer device to another transfer medium.

In an even further aspect of the present invention, the housing includes a process housing and transfer housing. The process housing is operable to contain the photoconductor element and the intermediate transfer device, the photoconductor element comprising a drum and the intermediate transfer device comprising a flexible belt. The transfer housing is tiltable, relative to the process housing, and includes a transfer roller. The transfer roller, when tilted into contact with the process housing, contacts in the intermediate transfer device to form a nip therewith. During this transfer operation, paper is pulled through the nip and the composite image transferred thereto.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
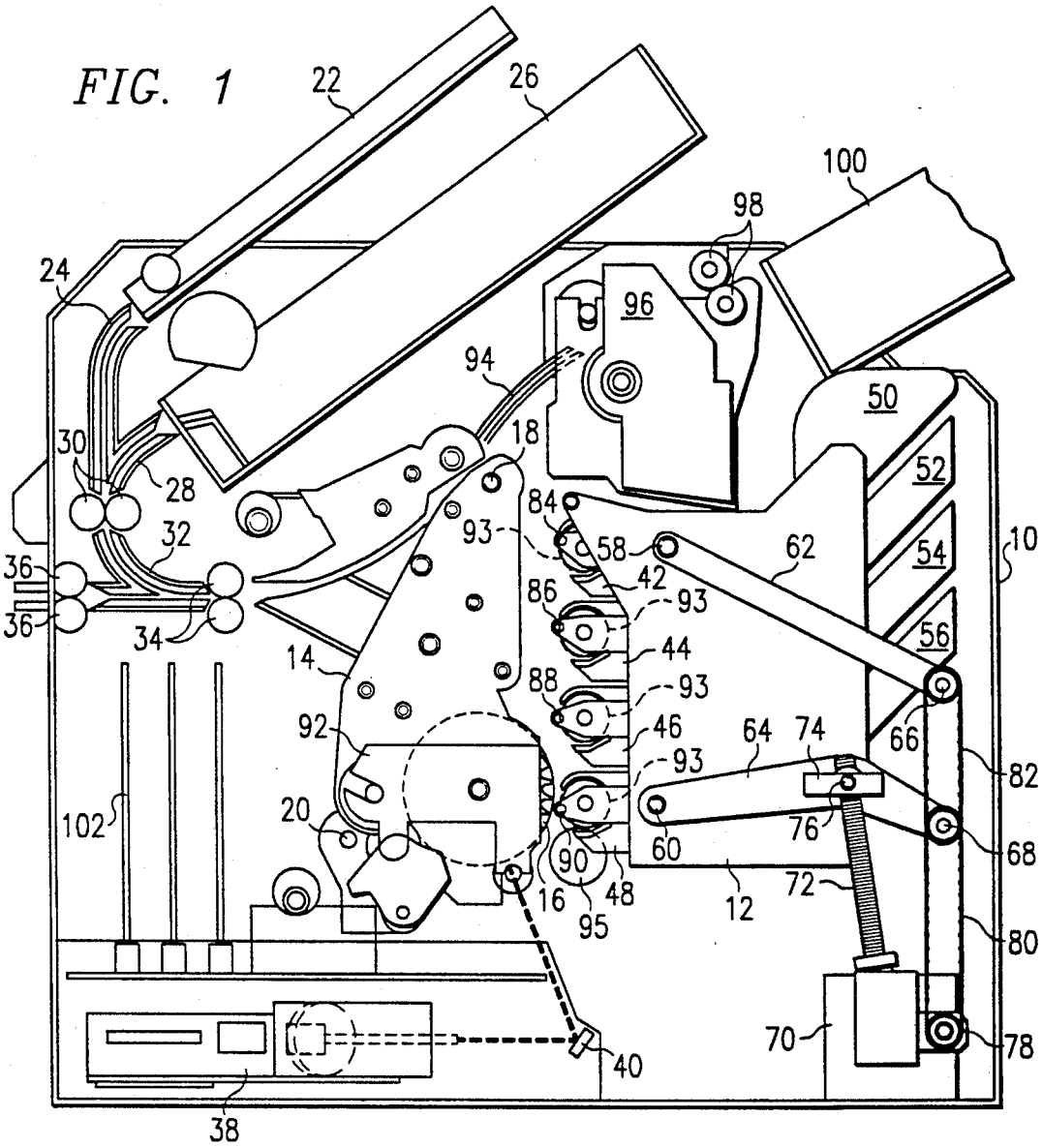
FIG. 1 illustrates a side view of an electrophotographic print engine utilized in an electrophotographic printer with an intermediate transfer mechanism.

Referring now to FIG. 1, there is illustrated a side detail view of the vertical print engine of the present invention. A housing 10 is provided for housing a toner module assembly 12 and a process cartridge 14. The process cartridge 14 is operable to contain a photoconductor drum 16 and a transfer belt (not shown) for receiving a developed image from the surface of the photoconductor drum 16 until all colors have been transferred thereto. The transfer belt (internal) is then operable to transfer the composite image from the upper end of the process cartridge 14. The process cartridge 14 is mounted on mounting pins 18 and 20 and is operable to be removed as a single element for replacement thereof. An upper paper tray 22 is provided that interfaces with a feed path 24. A lower paper tray 26 is provided that interfaces with a paper feed path 28. Paper feed paths 24 and 28 intersect at the nip of two feed rollers 30. The feed rollers 30 feed the paper from either of the trays 22 and 26 into a feed path 32, which is directed toward the nip of two feed rollers 34. Feed rollers 34 are operable to feed the paper into the upper end of the process cartridge 14 to receive the composite image therefrom. An alternate set of feed rollers 36 are provided to receive paper from the side of the housing 10 with the paper pulled into the nip of the rollers 36 and urged toward the paper feed path 32 and the drive rollers 34.

The lower side of the photoconductor drum 16 is illuminated with an image from an imaging device 38 that is disposed in the lower end of the housing 10. The illumination is redirected by a mirror 40 upwards to the underside of the process cartridge 14 and towards the lower surface of the photoconductor drum 16. The operation of this photoconductor drum 16 is similar to the operation of a photoconductor belt, as described in U.S. Pat. No. 4,652,115, issued to Palm, et al on Mar. 24, 1987, which is incorporated herein by reference.

The toner module assembly 12 is operable to hold four toner modules, a toner module 42 for containing a black toner, a toner module 44 for containing a cyan toner, a toner module 46 for containing a magenta toner, and a toner module 48 for containing a yellow toner. Each of the toner modules has associated therewith a toner bottle 50, 52, 54 and 56, respectively. The toner bottles 50–56 are operable to hold the respective toners for the toner modules 42–48, respectively. As will be described hereinbelow, each of the toner bottles 50–56 is separately removable from the toner modules 42–48 and the entire modules 42–48 are also selectively removable.

The toner module assembly 12 is connected on one side by two pivot points 58 and 60 to one end of pivoting links 62 and 64, respectively. Pivoting link 62 pivots at the other end thereof on one end of a shaft 66 and pivoting arm 64 pivots on the other end thereof on one end of a shaft 68. The pivoting arm 64 is rotated about the pivot point 68 by a motor assembly 70. The motor assembly 70 has disposed therein a gear-driven threaded rod 72, which threaded rod is operable to insert through a threaded nut 74 that is operable to pivot about a point 76 on link 64. As the threaded rod 72 is rotated, the nut 74 is urged upward or downward. The threaded rod 72 at the lower end thereof is operable to rotate about the assembly 70. A gear-reduction mechanism 78 is provided for providing a drive to belts 80 and 82 that rotate cams that are disposed on shafts 66 and 68. These cams, as will be described hereinbelow, are operable to urge the assembly 12 toward the photoconductor drum 16 and can utilize a heel crank type of cam. Further slots can be provided in which the shafts 66 and 68 reciprocate toward and away from the photoconductor member 16 via the action of a solenoid operated cam that rotates 180°. The shafts 66 and 68 extend from one side of assembly 12 to the other to allow pivoting of links similar to links 62 and 64.

In operation of the toner module assembly 12, each of the toner modules 42–48 are moved along an arc to one of four un-docked positions wherein the surface of the toner is disposed away from the surface of the photoconductor drum 16, which surface of the photoconductor drum 16 is an arcuate surface, although an arcuate surface is not required. Thereafter, the cams (not shown) at shafts 66 and 68 are operable to urge the toner assembly 12 from its un-docked position to a docked position. Each of the toner modules 42–48 has disposed on the outward end thereof a docking pin 84, 86, 88 and 90, respectively. A docking plate 92 is provided on each side of the cartridge 14 with four docking slots protruding outward from the side thereof. Each of the docking slots provides an alignment mechanism for the docking pins 84-90 to coordinate with. As will be described hereinbelow, this allows each of the toner modules to contact the surface of the photoconductor drum 16 at a different point thereon. Also, this provides for a rotating action to bring the toner modules in contact with the photoconductor drum 16 without requiring movement in a complete vertical direction, thus reducing the amount of space required for operation of the toner module assembly 12. It is important to note that the minimum distance between the toner modules is greater than the distance that the toner assembly must move in the vertical plane to change from one toner module to the next adjacent toner module.

Each of the toner modules 42–48 has a drive gear 93 disposed on the forwardmost end thereof that operates the toner delivering operation of the modules 42–48. When the toner modules 42–48 are placed in the docked position, the drive gear 93 contacts a gear 95 that is driven by a motor driven shaft (not shown). The gear 95 freely rotates on the same shaft as the photoconductor drum 16. Therefore, when each of the toner modules 42–48 are placed in the contact position, the gears 93 and 95 are engaged.

Once the image has been developed on the surface of the photoconductor drum 16, it is transferred internally in the process cartridge 14 to a transfer belt (not shown) until all colors in the composite image have been transferred to the transfer belt. Thereafter, the paper is pulled through the feed rollers 34 to initiate the transfer operation and the paper with the composite image is then transferred to a paper feed path 94 and into a fuser 96. The paper is then urged outward from the fuser by two feed rollers 98 to the paper holding tray 100.

The entire operation of the system is controlled by a processor portion 102, which consists of a plurality of component boards disposed adjacent to the process cartridge 14. The system operates in accordance with U.S. Pat. No. 4,652,115, with the timing controlled such that development occurs at a different location on the photoconductor drum 16 for each of the toner modules 42–48.

Figure 2:
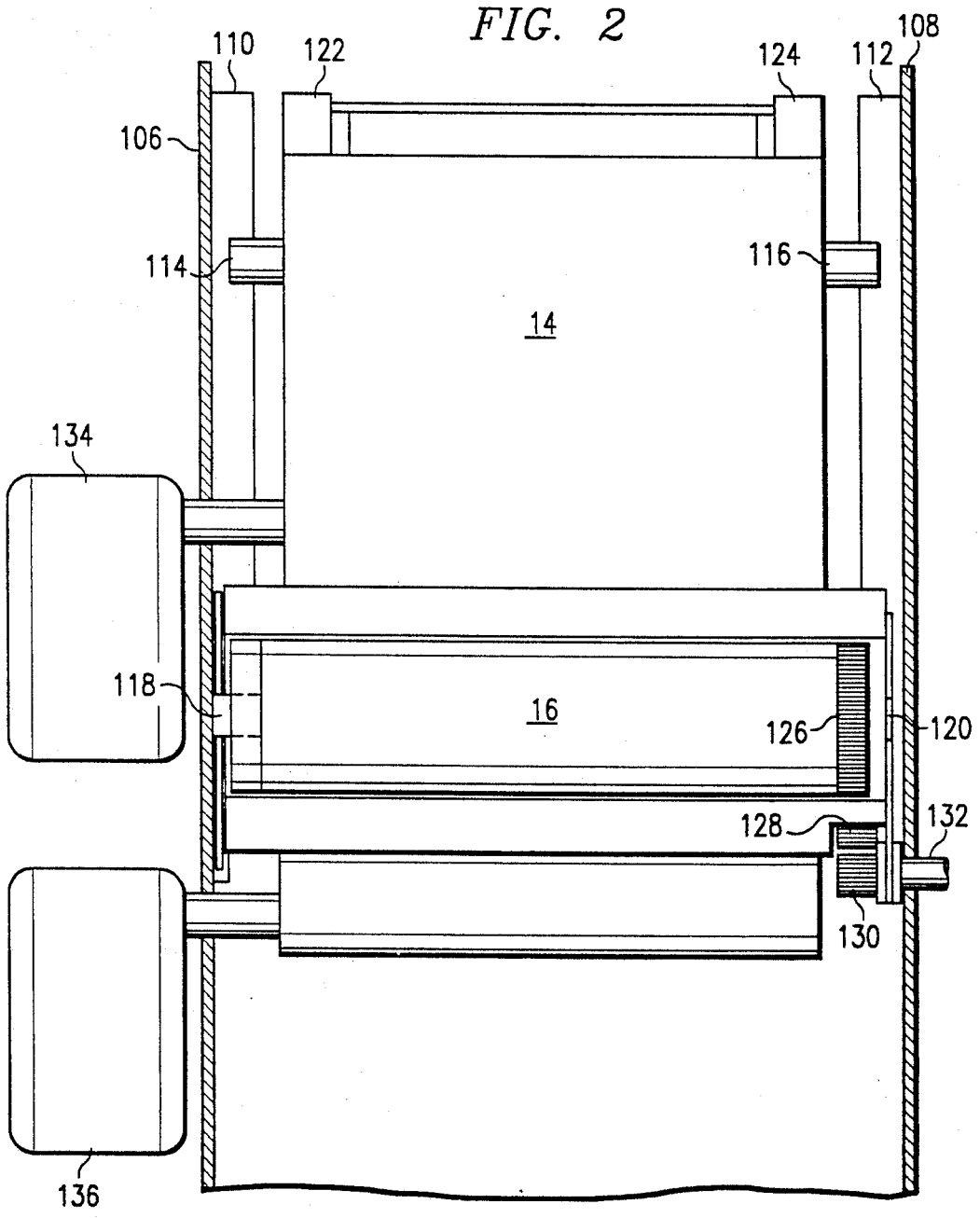
FIG. 2 illustrates a frontal view of the process cartridge and the chassis of the print engine.

Referring now to FIG. 2, there is illustrated a frontal view of the process cartridge 14 and the mounting thereof between interior panels 106 and 108 in the housing 10. The process cartridge 14 is mounted on front-and-back frame rails 110 and 112, respectively, by upper mounting pins 114 and 116 and lower mounting pins 118 and 120. The front frame rail 110 is operable to receive the mounting pins 114 and 118 and the rear frame rail is operable to receive the mounting pins 116 and 120. Top loading pads 122 and 124 are provided on either side of the cartridge 12. The photoconductor drum 16 has a gear 126 disposed on one side thereof. The gear 126 is operable to interface with a motor drive gear 128 that is mounted on the end of a motor shaft 132. The motor shaft 132 is connected to the driving mechanism of the system. This is conventional and is not illustrated here. An upper waste bottle 134 is operable to be connected to the process cartridge 12 at the upper end thereof for collecting waste and a waste toner bottle 136 is disposed at the lower end of the process cartridge 12, as will be described hereinbelow.

Figure 3:
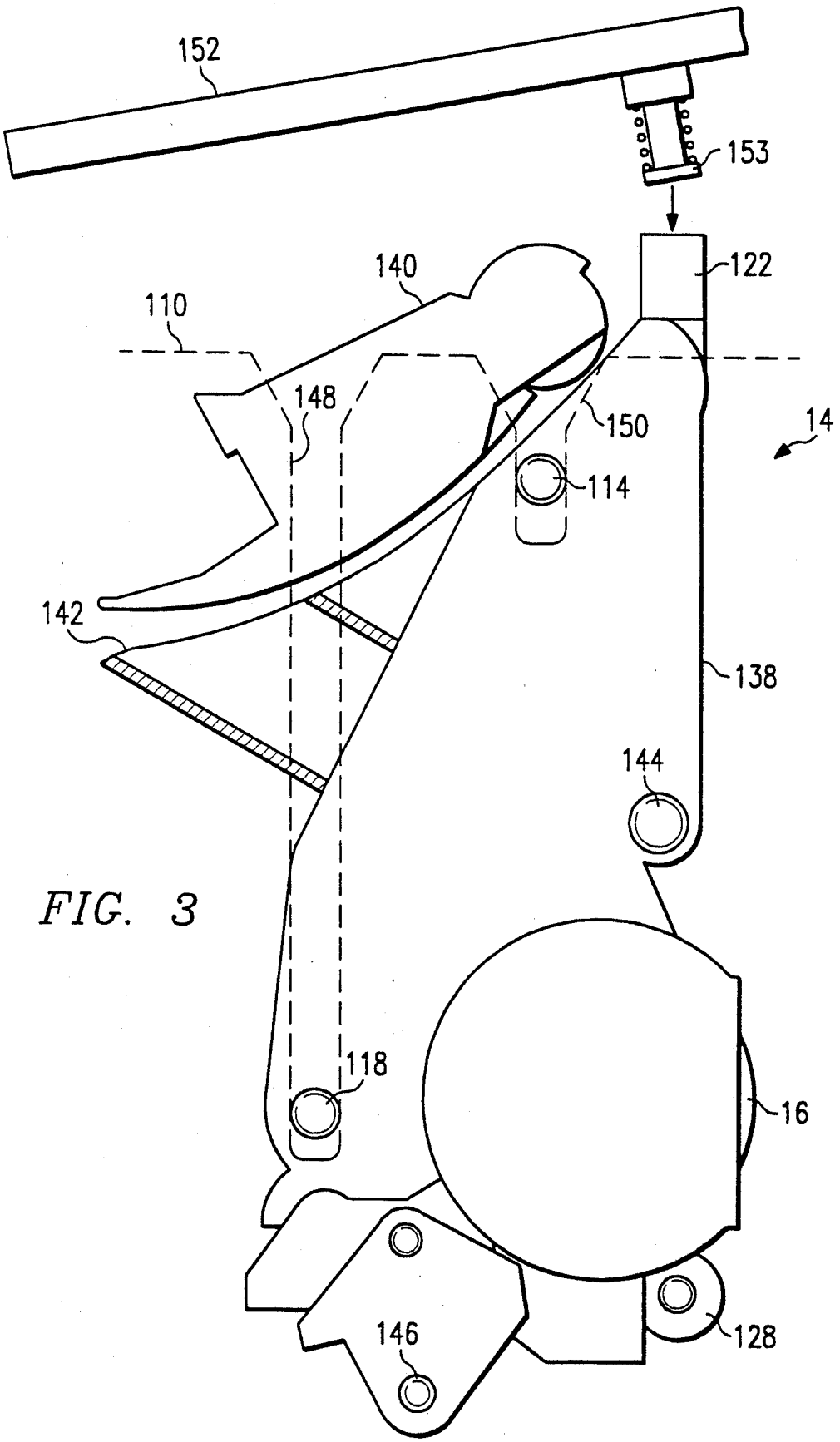
FIG. 3 illustrates a side view of the exterior of the process cartridge and the mounting/alignment thereof.

Referring now to FIG. 3, there is illustrated a side view of the process cartridge 14 illustrating the mounting thereof. The process cartridge 14 is comprised of a process housing 138 and a transfer housing 140. The transfer housing 140 is pivotable, as will be described hereinbelow, relative to the process housing 138. The transfer housing 140 is activated only during transfer of the composite image onto paper, which constitutes a final transfer medium. Paper is fed into a paper guide plate 142 and out the upper end of the process cartridge 14 through guide feed path 94 and then into the fuser 96, as was described above. The process cartridge 138 has attached thereto the alignment pins 114 and 118 on one side thereof (the opposite side not shown). A waste outlet 144 is provided for interfacing with the upper waste bottle 134 and a waste outlet 146 is provided for interfacing with the lower waste bottle 136. The frame guide rail 110 is illustrated in phantom, showing a deep slot 148 for receiving the alignment pin 118 and a shallow slot 150 illustrated for receiving the alignment pin 114. Therefore, it can be seen that the process cartridge 14 is merely dropped into the print engine such that the alignment pins 118 and 114 fall into slots 148 and 150, respectively. This allows for exact alignment of the process cartridge with the motor shaft 132 and the gear 128.

A top cover 152 is provided that is hinged (not shown) with a top-loading device 153 illustrated on the bottom of the cover 152. When the cover 152 is closed, it exerts pressure on the top-loading pad 122 to securely hold the process cartridge 14 in the print engine.

Figure 4:
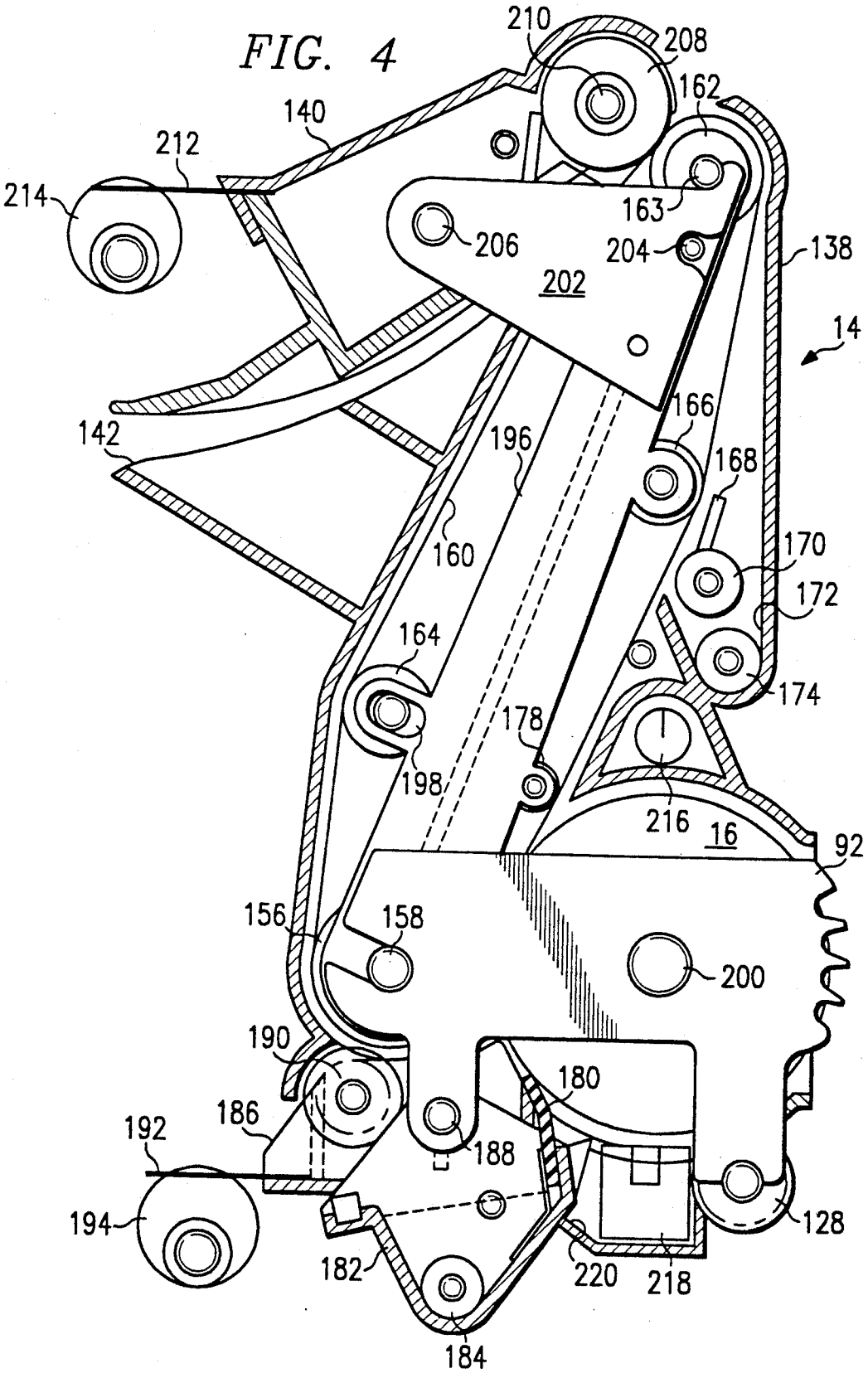
FIG. 4 illustrates a side view of the process cartridge illustrating the support member internal thereto for supporting the various processing elements.

Referring now to FIG. 4, there is illustrated a side view of the process cartridge 14 illustrating the mounting brackets for holding the various processing elements. The process housing 138 is operable to contain a transfer drive roller 156 that is mounted on a shaft 158 for driving a transfer belt 160. The other end of the transfer belt is disposed on a transfer backup roller 162. The transfer belt 160 is operable to come in contact with the photoconductor drum 16 to receive multiple images in an intermediate transfer operation, which images have been developed and are transferred in sequence to the belt 160 until a composite image has been formed. The operation of this is described in U.S. Pat. No. 4,652,115. A tension roller 164 is provided on the rear of the process housing 138 and a cleaning backup roller 168 is provided on the front of the process housing 138 behind the belt 160. Proximate to the transfer belt 160 on the opposite side thereof from the backup roller 166, a cleaning blade 168 is disposed. The cleaning blade 168 is disposed on a cam-operated mechanism 170 and is operable to be actuated to contact the transfer belt 160 for a cleaning operation after a composite image has been transferred to the fuser 96. A waste reservoir 172 is provided beneath the cleaning blade 168 to receive waste toner that is removed from the transfer belt 160 by the cleaning blade 168. A waste toner auger 174 is provided in the bottom of the reservoir 172 and is operable to interface with the output 144, which is interfaced with the upper waste bottle 134.

An electrode-roller 178 is provided for charging the transfer belt 160 to a predetermined level, as was described in U.S. Pat. No. 4,652,115. A second cleaning blade 180 is provided that is disposed adjacent a lower waste housing 182 for contacting the PC drum 16 after transfer of the developed latent image therefrom. The PC drum 16 rotates in a counter-clockwise direction, with the cleaning blade 180 directed upward thereagainst to remove the toner that may remain that was not transferred to the transfer belt 160. A waste toner auger 184 is disposed in the bottom of the housing 182 for routing waste into the lower waste bottle 136. A pivoting cleaning housing 186 is provided that is disposed on the bottom of the process housing 138 that pivots about a pivot point 188. The housing 186 contains a cleaning roller 190, which is operable to provide intermittent cleaning of the transfer belt 160, as was disclosed in U.S. patent application Ser. No. 422,770, filed Oct. 17, 1989, and entitled "METHOD AND APPARATUS FOR INTERMITTENT CONDITIONING OF A TRANSFER BELT", which is incorporated herein by reference. An arm 192 extends rearward from the process housing 138 and contacts an externally driven cam 194, which is operable to provide the correct timing and urge the cleaning roller 190 into contact with the transfer belt 160 against the transfer drive roller 156.

A mounting bracket 196 is provided in the process housing 138 to hold the shafts 158 and 163. Bracket 196 also holds the backup roller 166 and the tension roller 164. The tension roller 164 is contained in a slot 198 in the bracket 196. The plate 92, containing the alignment slots, is disposed on the shaft 158, the pivoting pin 188 and a shaft 200 on which the photoconductor drum 16 rotates. The plate 92 is provided on either side of the photoconductor drum 16 and has a protrusion that extends downward to interface with the shaft upon which the gear 128 is mounted to align the gear 126 with the gear 128. An upper plate 202 is provided that is mounted such that it rests on an alignment pin 204 in the shaft 163. The transfer housing 140 pivots on a pivoting shaft 206 on the rearmost,, portion of the plate 202 and is secured to bracket 196 with a screw 203. The transfer housing 140 contains a transfer roller 208 that rotates on a shaft 210. An arm 212 extends rearward of the transfer housing 140 and contacts a transfer cam 142 (external) that is operable to tilt the transfer roller 208 in contact with the transfer belt 160 and form a nip therebetween in co-action with the roller 162. Paper fed into the feed plate 142 will then be grasped by the nip and the transfer operation completed. The roller 208 has an electrode (not shown) connected thereto to provide a charge thereto for assisting in the transfer operation. A pre-nip discharge lamp 216 is provided which is disposed above the PC drum 16. A charging corona 218 is disposed beneath the PC drum 16 in a housing 220.

The predischarge lamp 216, although illustrated as being a portion of the process cartridge 14, in actuality is a lamp that is disposed to the side of the process cartridge 14 and does not move with the process cartridge 14. In the preferred embodiment, a cavity 217 is provided which is open from either side of the process cartridge 14. Slots 219 are disposed on the lower side of the cavity 217 such that the cavity 217 is exposed to the surface of the photoconductor drum 16. Therefore, the lamp 216 (which is external to the cartridge 14 on either side thereof) can illuminate the cavity 217 from either side of the process cartridge 14 and light can illuminate the surface of the photoconductor drum 16 through slots 219. By utilizing such a configuration, it is not necessary to include lamps in the process cartridge 14.

The plate 202 and the bracket 196 are molded of a single piece injected molded plastic with a rib illustrated along the length thereof as a phantom line. The plate 92 is typically a metal plate as it is utilized for precision alignment. The process housing 138 is also a molded plastic part. During assembly, the transfer belt 160 is disposed on the respective rollers about the bracket 196 and then mounted into the housing 138, the bracket 196 secured thereto by screws (not shown). In addition, the plate 92 is secured to the bracket 196 with screws (not shown). Therefore, the entire assembly is aligned relative to the housing 138 and secured to the bracket 196.

The roller 162 is utilized during a tensioning operation of the belt 160. When the plate 202 is removed, the shaft 163 is operable to slide toward the center of the bracket 196 in a slot (not shown). This allows the belt 160, which is flexible, to collapse and allow removal and replacement thereof. When the plate 202 is replaced, the shaft 163 is urged outward to tension the belt 160, therefore providing a coarse tension adjustment. Thereafter, the tension roller 164 can be tightened to provide the final tension adjustment. By utilizing the tensioning operation of the roller 162 on its shaft 163, less room for adjustment is required for the tension roller 164. The tension roller 164 can then be utilized for fine adjustments in the tension as opposed to a coarse adjustment.

The plate 92 has disposed thereon the docking slots on the outer surface thereof for receiving the docking pins 84–90 on the toner modules 42–48, respectively. The plate 92 provides an important function. First, it allows alignment of the entire process cartridge with the gear 128 through the protrusion 201. Additionally, it provides an important alignment function to each of the toner modules 42–48 with respect to the surface of the photoconductor drum 16. Since there is a docking plate 92 on either side of the photoconductor drum 16, the docking pins associated with the toner modules 42–48 provides and alignment that maintains the toner modules 42–48 parallel to the longitudinal axis of the photoconductor drum 16. As such, this will account for any tolerance problems in the alignment of a removable process cartridge and a separate toner assembly.

Figure 5:
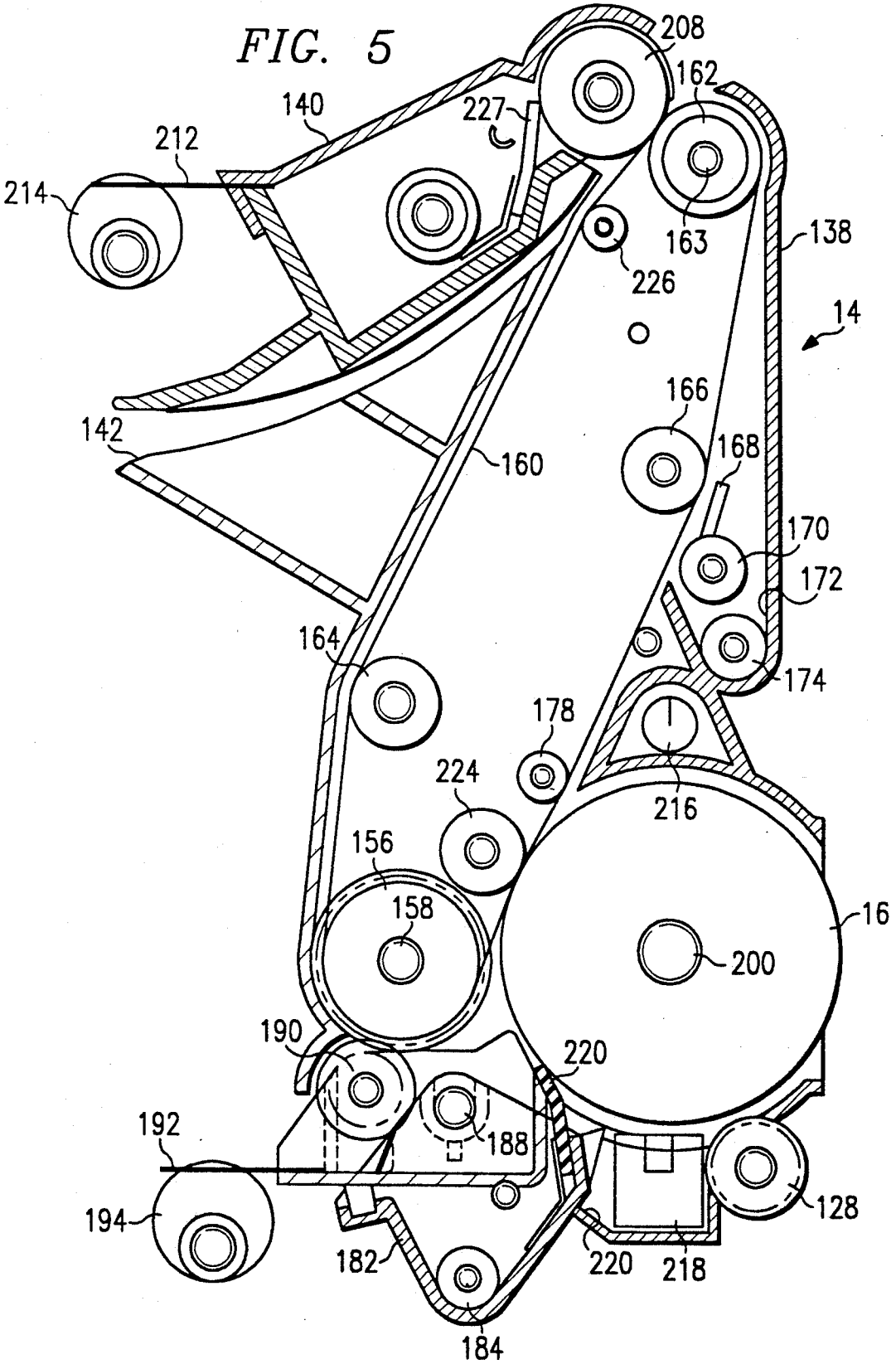
FIG. 5 illustrates a side view of the process cartridge illustrating the arrangement of the process elements therein.

Referring now to FIG. 5, there is illustrated a cross-sectional view of the process cartridge 14, illustrating the processing elements. The transfer belt 160 is driven by the transfer drive roller 156 in a clockwise direction with the photoconductor drum 16 driven in a counterclockwise direction. A transfer backup roller 224 is provided on the diametrically opposite side of the transfer belt 160 from the photoconductor drum 16 to hold the transfer belt 160 firmly against the photoconductor drum 16. In operation, the transfer electrode roller 178 is operable to charge the surface of the transfer belt 160, and then transfer of the image from the photoconductor drum 16 is effected to the transfer belt 160. As described above, this is a developed image. The entire composite image will be made up through multiple passes of the transfer belt 160 and the image area thereon past the photoconductor drum 16. Once all of the composite images have been transferred to the transfer belt 160, the transfer cam 214 is activated and the transfer housing 140 is tilted up such that the transfer roller 208 contacts the transfer belt 160 proximate to the roller 162, which comprises a backup roller. A grounding electrode 226 mounted prior to the roller 162 is operable to remove the charge from the belt 160. A nip is formed between the roller 208 and the roller 162 with the transfer belt 162 passing through the nip and then paper allowed to feed through the paper guide 142 into the nip. The composite image on the transfer belt 160 is therefore transferred to the paper and then the paper routed out to the fuser 96. A cleaning blade 227 is provided in the transfer housing 140 for cleaning any residual toner that may be present on the roller 208. This 227 blade operates similar to the blade 180 since it is not necessary to retain any image or any toner on the photoconductor drum 16 or the transfer roller 208.

A belt timing index sensor 225 is disposed between the rollers 162 and 166 and is operable to provide timing information to the main processor. Additionally, a toner density sensor 227 is also provided proximate to the index sensor 226 for sensing toner density levels. Although not shown, electrical connections are provided for connecting the various electrical processing elements to the main processor.

After the paper has been transferred to the fuser, the process enters a cleaning stage. In this stage, the cleaning blade 168 is placed in contact with the transfer belt 160 to remove residual toner from the surface of the transfer belt 160, the residual toner allowed to fall into the container 170 or 172 and removed therefrom by the waste toner auger 174. Thereafter, the surface of the belt 160 is again charged and another image transferred from the photoconductor drum 16 to transfer belt 160.

Figure 6:
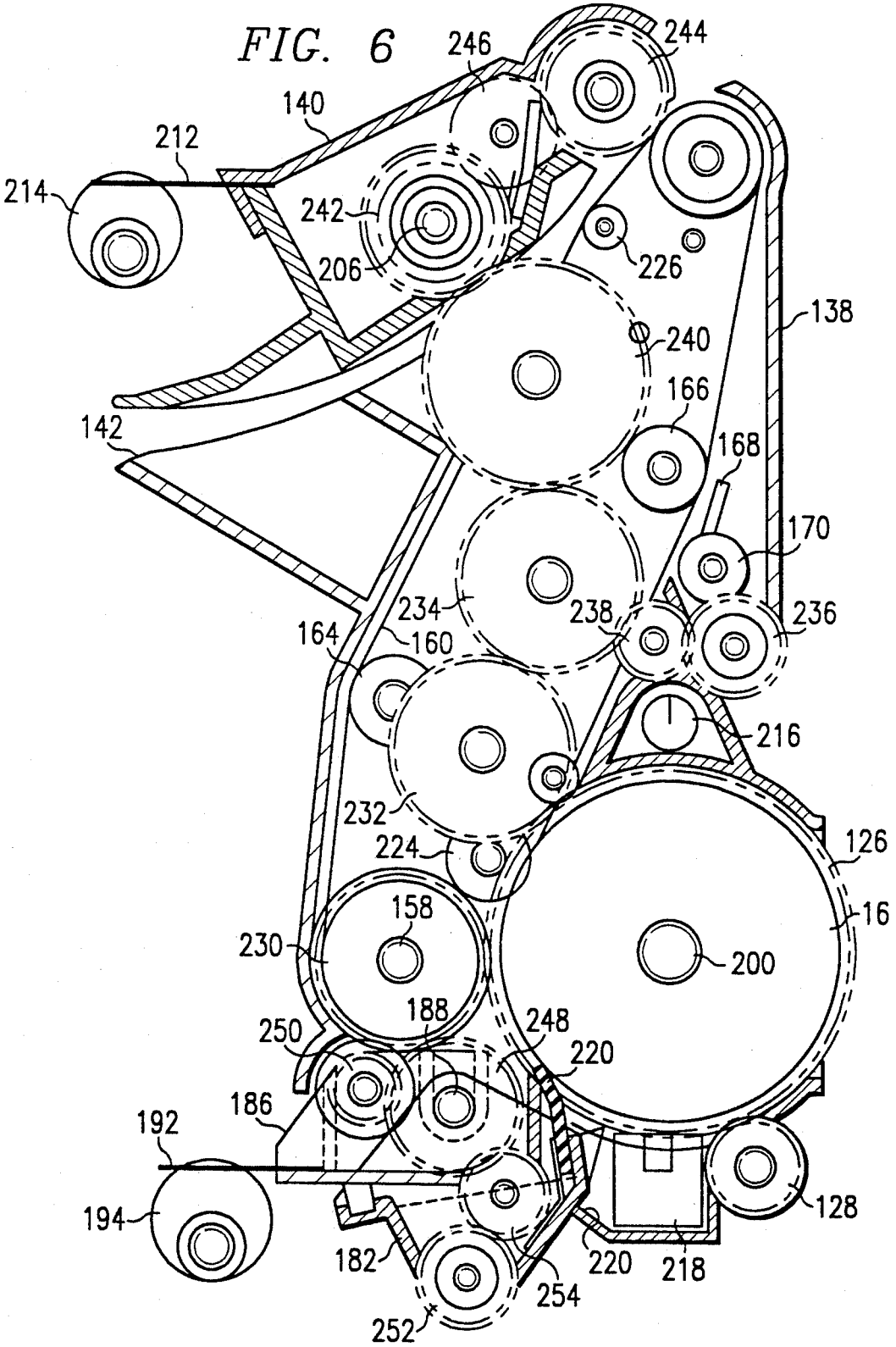
FIG. 6 illustrates a side view of the gear arrangement for the process cartridge.

Referring now to FIG. 6, there is illustrated a side view of the gear layout for the process cartridge 14. The view illustrated in FIG. 6 is a mirror image of the opposite side of the process cartridge 14, it being understood that the gears can be disposed on either side of the process cartridge 14. This view is for simplicity purposes. The gear 126 is disposed on one end of the shaft 200 and is driven by the motor input gear 128. The gear 126 drives a gear 230 on the shaft 158 that drives the transfer drive roller 160 (not shown). In addition, the gear 126 also drives an idler gear 234. The gear 234 is operable to drive a waste toner auger gear 236 through an idler gear 238. The gear 234 also drives a transfer idler gear 240 that drives a gear 242 on the pivot shaft 206 as described above. Therefore, as the transfer housing 148 rotates, the gear 206 maintains the same spatial relationship relative to the gear 240. The gear 242 is operable to drive a drive gear 244 on the roller 208 through an idler gear 246.

The gear 230 on the transfer drive roller 156 is also operable to drive an idler gear 248 on the shaft 188. The shaft 188 is a shaft on which the housing 186 rotates. As described above, the housing 186 is operable to contain the roller 190 and the gear 180. Gear 248 is operable to drive a gear 250 on the roller 190. In addition, the gear 248 also drives a waste toner auger gear 252 to drive the waste toner auger 184, through an idler gear 254.

Figure 7:
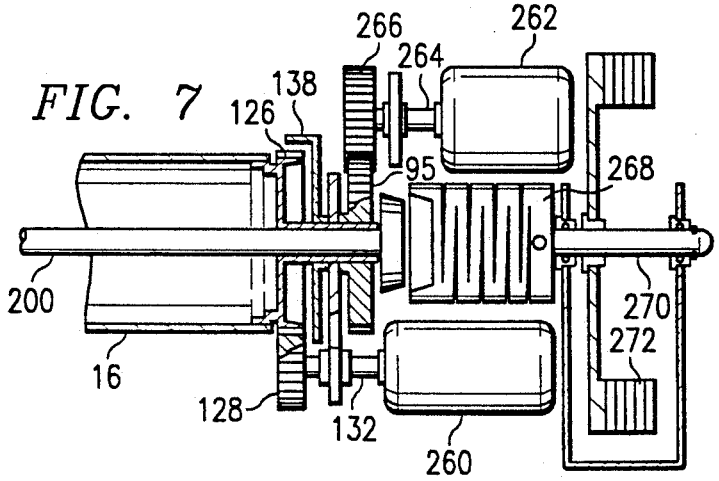
FIG. 7 illustrates a detail of the driving mechanism for interfacing with the toner modules.

Referring now to FIG. 7, there is illustrated a detailed diagram of the driving mechanism for the photoconductor drum 16. The shaft 132 is connected to a drive motor 260 and a toner module drive motor 262 is also provided that has a motor shaft 264 operable to drive a gear 266 that meshes with the toner idler gear 95 as described above. The toner idler gear 95 freely rotates on the shaft 200 and is operable to mesh with the gears 93 on each of the toner modules 42–48 when they are engaged with the slots on the end of the plate 92.

The end of the shaft 200 is also operable to engage with a slip-clutch type mechanism 268 through a friction fit (shown in an expanded configuration) which is attached to a flywheel 272. When the slip-clutch type mechanism 268 is interfaced with the end of the shaft 200, there is a friction fit that allows the shaft 200 to turn the flywheel 272. This provides for a smooth operation.

In summary, there has been provided an electrophotographic print engine having all of the processing elements therein contained within a single removable process cartridge. The processing elements are disposed such that a photoconductor drum is provided having a portion thereof exposed for the purpose of first receiving an external illumination stimulus to form a latent image on the surface of the drum and then receive toner from external toner modules to develop the latent image. The latent image is then transferred to an internal transfer belt for allowing the build-up of multiple layers to form a multi-layer composite image. The multi-layer composite image is then transferred from the transfer belt outward from the cartridge to an external fuser. The photoconductor drum and transfer belt are included in a process housing with a transfer roller provided in a transfer housing, both the transfer housing and the process housing forming the process cartridge. The transfer housing is pivotal relative to the process cartridge and is activated only during the process step.

Although the preferred embodiment has been described in detail, it should be understood that various changes, substitutions and alterations can be made therein without departing from the spirit and scope of the invention as defined by the appended claims.

What is claimed is:

1. A process cartridge for a multi-layer electrophotographic print engine, comprising:

a process housing containing:

a photoconductor element for carrying a latent image proximate to a developing station for receiving toner therefrom and developing said latent image on said photoconductor element, and an intermediate transfer device for receiving multiple developed images from said photoconductor element to form a multi-layer composite image; a transfer housing for containing;

a transfer roller that is operable to contact said intermediate transfer device and form a nip therewith during a transfer operation, said transfer housing operable to be tilted relative to said process housing such that said transfer roller is moved into contact with said intermediate transfer device during said transfer operation wherein a transfer medium is fed into said nip and said composite image is transferred to said transfer medium;

a main housing for containing said process housing and said transistor housing; and an alignment device connected to said main housing for aligning and securing said main housing in the electrophotographic print engine; and a driving apparatus for interfacing with an external driving mechanism and driving said photoconductive element, intermediate transfer device and said transfer roller within said main housing to control the operation thereof to process said latent image.

2. The process cartridge of claim 1, wherein said alignment device comprises:

a plurality of alignment pins disposed on the side of said main housing and operable to be received in slots on frame plates associated with the electrophotographic print engine; and a hold-down device for securing said alignment pins in the slots of the frame plates.

3. The process cartridge of claim 1, wherein said photoconductor elements is operable to interface with an external toner device for applying toner to said latent image for developing thereof.

4. The process cartridge of claim 3, wherein said photoconductor element is operable to interface with a plurality of separate toner cartridges, each of said separate toner cartridges containing a separate toner for each of said layers in said multi-layer composite image.

5. The process cartridge of claim 1, wherein said photoconductor element is operable to receive toner from an external toner containing module to form a developed image on said photoconductor element.

6. The process cartridge of claim 5, wherein said photoconductor element comprises a photoconductor drum.

7. The process cartridge of claim 5, wherein said intermediate transfer device is operable to receive multiple developed images to form a multi-layer composite image thereon for transfer to said transfer medium external to said process housing after the formation of said multi-layer composite image.

8. The process cartridge of claim 1, wherein said driving apparatus comprises a single input drive mechanism for interfacing with a single driving device in the electrophotographic engine, said single input driving device for transferring said input drive to said photoconductive element, intermediate transfer device and said transfer roller.

9. The process cartridge of claim 1, wherein said intermediate transfer device comprises a flexible belt.

10. The process cartridge of claim 9, wherein said flexible belt is not circular.

11. The process cartridge of claim 1, wherein said intermediate transfer device comprises a flexible belt having a backup roller associated therewith proximate to said transfer roller when said transfer roller is tilted into contact with said intermediate transfer device to form said nip thereat.

12. A method for containing processing elements in a multi-layer electrophotographic engine, comprising the steps of:

providing a main housing for containing a process housing and a transfer housing;

securing a photoconductor member on one end of the process housing and operable to be exposed to the exterior of the process housing for receiving an exposure suitable to form a latent image on the surface thereof and for receiving toner to allow developing of the latent image;

securing an intermediate transfer mechanism in the process housing;

interfacing the intermediate transfer mechanism with the photoconductor element to allow transfer of multiple developed images to the intermediate transfer device, such that multiple images can be overlaid to form a composite image having multiple layers;

securing a transfer roller in the transfer housing;

tilting the housing relative to the process housing such that the transfer roller interfaces with the intermediate transfer device to form a nip therewith during a transfer operation to feed a transfer medium through the nip for transfer of the composite image thereto during the transfer operation;

aligning and securing the main housing in the electrophotographic print engine in an operating position;

interfacing the processing elements contained in the main housing with an external driving mechanism; and driving the photoconductor member, intermediate transfer mechanism and transfer roller with the driving mechanism within the main housing to control the operation thereof.

13. The method of claim 12, wherein the intermediate transfer device is a flexible belt that is not circular in shape.

* * * * *